US008205275B2

(12) United States Patent
Yuen

(10) Patent No.: US 8,205,275 B2
(45) Date of Patent: Jun. 26, 2012

(54) EXTERNAL AUTOMATIC FLUSH HELPER

(76) Inventor: Leung Sik Yuen, Tsuen Wan (CN)

( * ) Notice: Subject to any disclaimer, the term of this patent is extended or adjusted under 35 U.S.C. 154(b) by 861 days.

(21) Appl. No.: 12/167,314

(22) Filed: Jul. 3, 2008

(65) Prior Publication Data

US 2009/0113614 A1 May 7, 2009

(30) Foreign Application Priority Data

Nov. 5, 2007 (CN) ..... 2007 2 0193252 U

(51) Int. Cl.
*E03D 1/00* (2006.01)

(52) U.S. Cl. ..... 4/313; 4/410

(58) Field of Classification Search ..... 4/313, 405, 4/410
See application file for complete search history.

(56) References Cited

U.S. PATENT DOCUMENTS

| | | | | |
|---|---|---|---|---|
| 4,748,700 | A * | 6/1988 | Wooten | 4/661 |
| 5,685,026 | A * | 11/1997 | Chuang | 4/364 |
| 6,202,227 | B1 * | 3/2001 | Gurowitz | 4/313 |
| 7,140,050 | B2 * | 11/2006 | Muderlak | 4/405 |
| 7,461,418 | B2 * | 12/2008 | Vlahos et al. | 4/661 |
| 2003/0154542 | A1 * | 8/2003 | Goda | 4/300 |
| 2006/0010591 | A1 * | 1/2006 | Bush | 4/406 |
| 2008/0078014 | A1 * | 4/2008 | Wilson et al. | 4/313 |
| 2008/0109953 | A1 * | 5/2008 | Gonzalez | 4/313 |

* cited by examiner

*Primary Examiner* — Gregory Huson
*Assistant Examiner* — Karen L Younkins

(57) ABSTRACT

An external automatic flush helper comprises a housing and fixing means for fixing the housing onto a toilet tank. Within the housing there are provided with a DC power supply, a controller powered by the DC power supply, an infrared sensor and a motor connected with the controller, and an actuating mechanism connected with the motor. An end actuator of the actuating mechanism is arranged in alignment with the button of the toilet tank. The end actuator can be actuated and move out of an opening in the housing when a user status is detected by the infrared sensor, and thus press the button of the toilet tank. Therefore, automatic flushing can be achieved contactlessly.

6 Claims, 4 Drawing Sheets

EXTERNAL AUTOMATIC FLUSH HELPER

BACKGROUND OF THE INVENTION

1. Field of the Invention

The present invention relates to an external automatic flush helper, which is installed on a toilet tank.

2. Description of the Prior Art

The toilet is a common sanitary ware. After using toilet, it is usually necessary to press the button provided on the top surface of the toilet tank to flush. However, nowadays, people pay more and more attention to personal health, trying their best to reduce the possibilities of contacting the bacteria and wishing to flush the toilet without having to press the flush button on the toilet tank especially when using the public toilet.

Both US Pat. Publication No. 2006/0130225 and U.S. Pat. No. 5,603,127 disclosed a conventional automatic flush helper. These two automatic flush helpers are both installed in the toilet tanks and both utilize an infrared sensor to realize automatic flushing. However, since it is installed in the toilet tank, the conventional automatic flush helper must be protected from water by a seal structure, otherwise its operation would be adversely affected. In addition, since the conventional automatic flush helper is installed in the tank, in order not to affect the water storage capacity, the volume of the conventional automatic flush helper must be restricted. Moreover, the installation of these two conventional automatic flush helpers is quite complex and can only be done by professionals.

The present invention has arisen to mitigate and/or obviate the afore-described disadvantages.

SUMMARY OF THE INVENTION

The primary objective of the present invention is to provide an external flush automatic helper, which can achieve automatic flushing contactlessly and is easy to install.

In order to achieve the above objective, the external flush automatic helper in accordance with the present invention comprises a housing and fixing means for fixing the housing onto a toilet tank, within the housing are provided a DC power supply, a controller powered by the DC power supply, an infrared sensor and a motor being connected with the controller, and an actuating mechanism connected with the motor. An end actuator of the actuating mechanism is arranged in alignment with a button of the toilet button, and the end actuator can be actuated and moves out of an opening in the housing when a user status is detected by the infrared sensor and thus presses the button of the toilet tank.

With the external automatic flush helper, the user can achieve the automatic flushing contactlessly, thus reducing the possibilities of contacting the bacteria. In addition, because the flushing is automatically achieved, the probability of forgetting to flush due to carelessness can be thoroughly avoided.

According to one embodiment of the present invention, the fixing means are suckers installed on a bottom of the housing. The structure of the suckers is varied as desired, such as double-sides sticker, velcro tape or plastic ring.

According to another embodiment of the present invention, the DC power supply is a battery or a battery pack, which supplies a voltage of 6 volts.

According to another embodiment of the present invention, the housing is provided with accessories, which are selected from the group consisting of clocks, perfume boxes, music boxes, temperature gauges and humidity meters, thus extending the functions of automatic flush helper.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
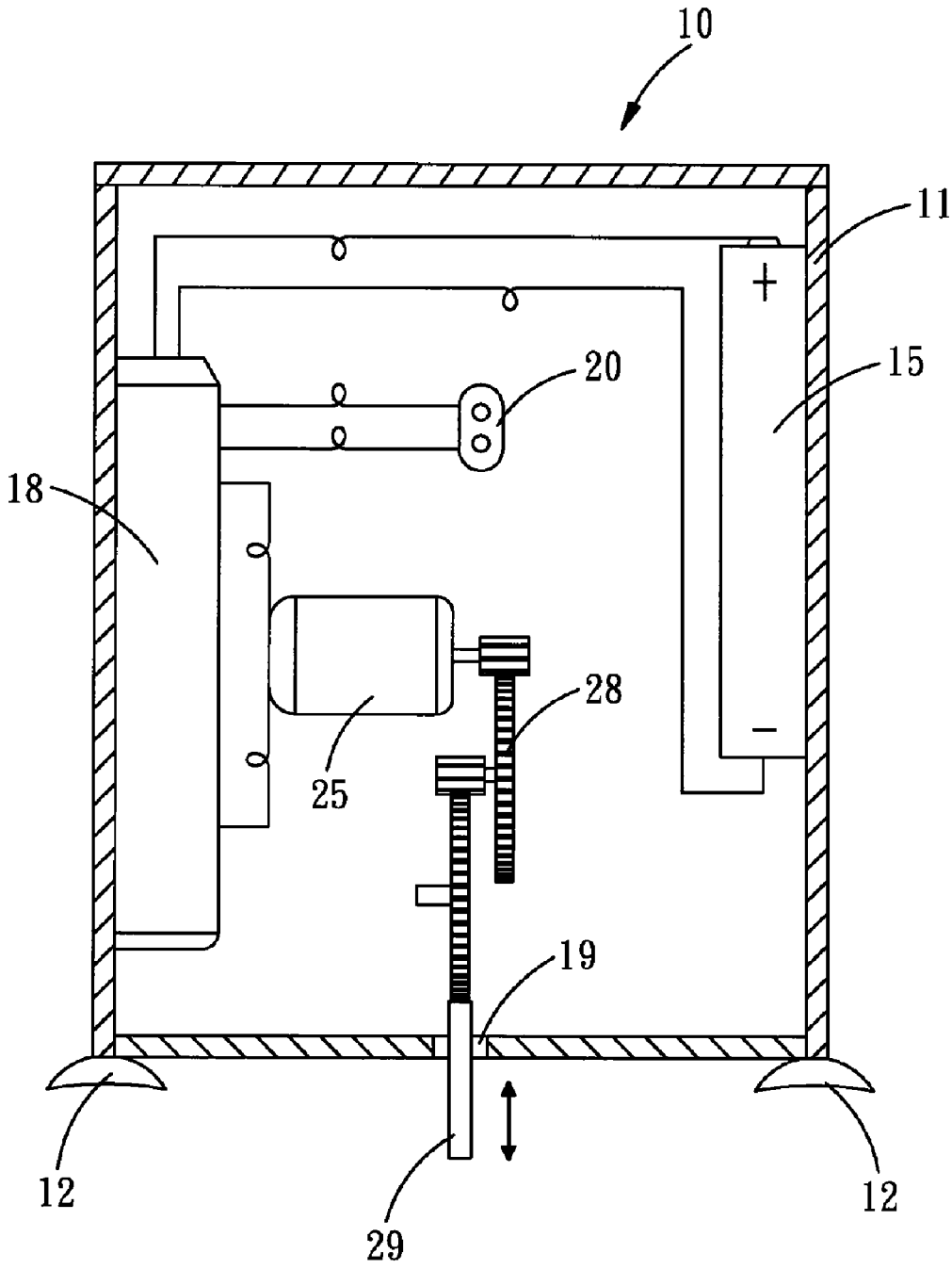
FIG. 1 is a structural view of an external automatic flush helper in accordance with the present invention.
Figure 2:
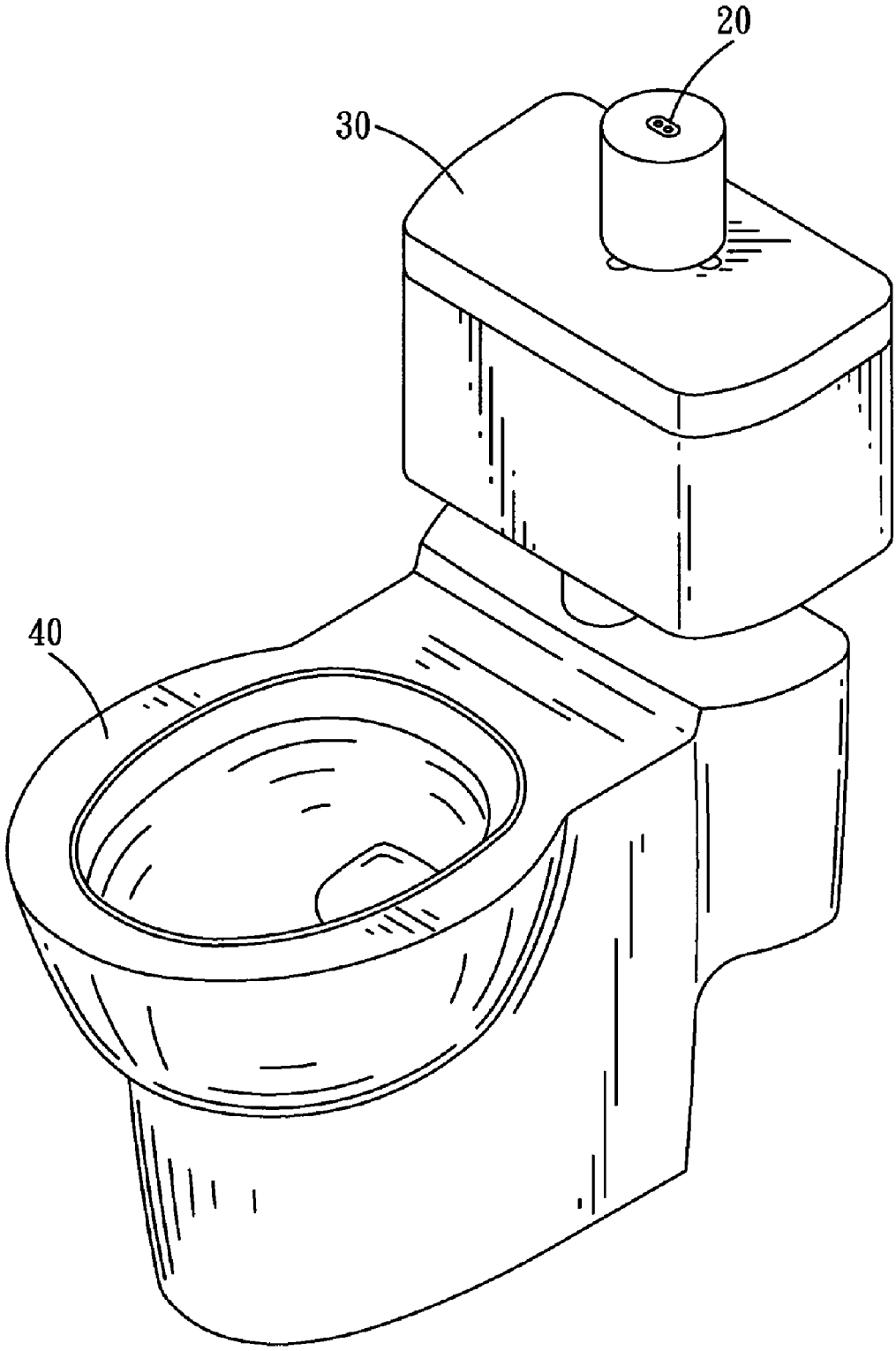
FIG. 2 shows how the external automatic flush helper in accordance with the present invention is installed on a toilet tank.
Figure 3:
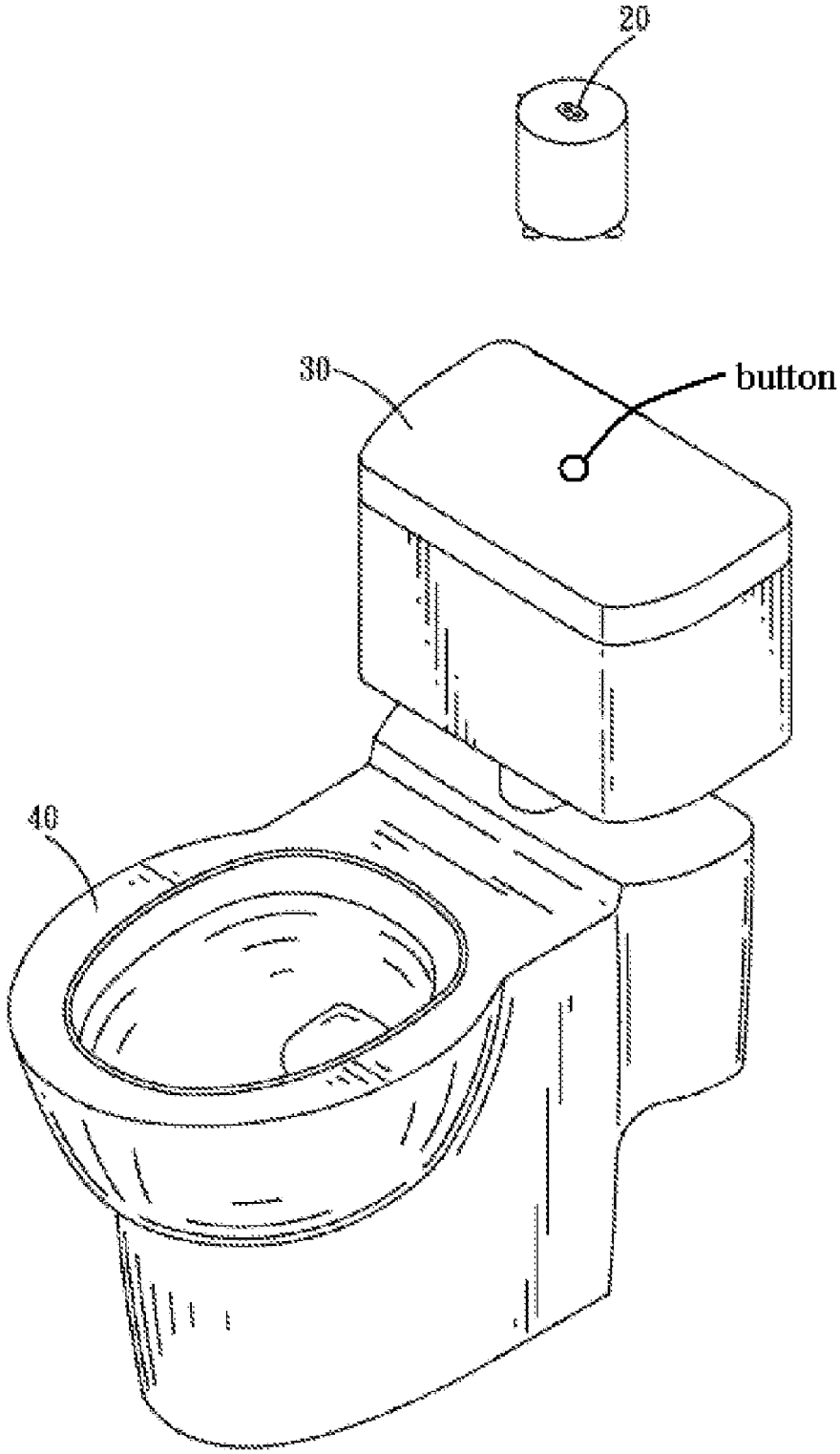
FIG. 3 is a schematic view of the external automatic flush helper installed on a button on the toilet tank in accordance with the present invention.
Figure 4:
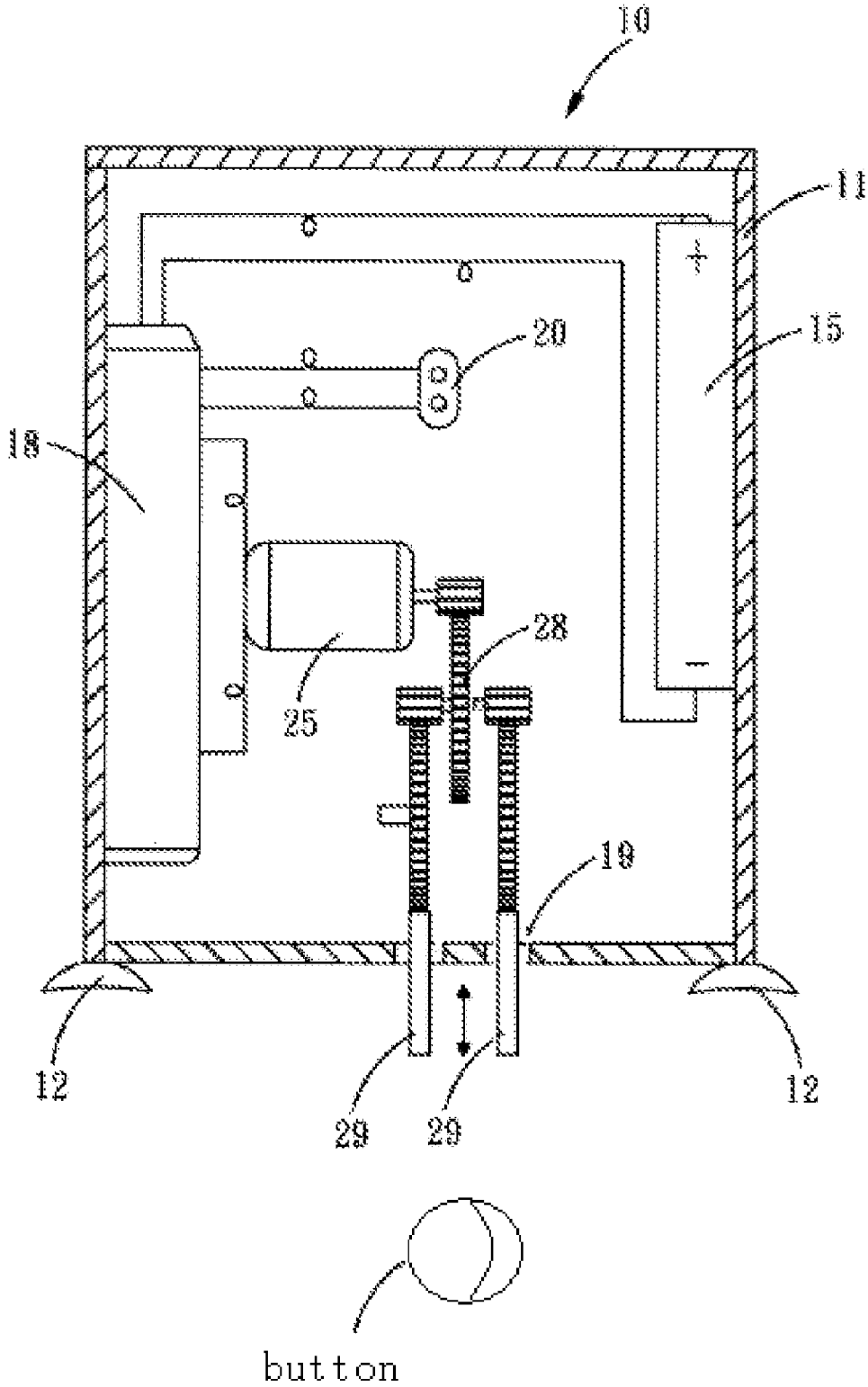
FIG. 4 shows how two end actuators of the external automatic flush helper installed on a button having a small flush and a big flush on the toilet tank in accordance with the present invention.

Referring to FIG. 1, an external automatic flush helper in accordance with the present invention comprises a housing 11 and fixing means for fixing the housing 11 onto a toilet tank 30 (as shown in FIG. 2). In the embodiment shown in FIG. 1, the fixing means are suckers 12. The structure of the suckers 12 can be varied as desired, such as double-sides sticker, velcro tape or plastic ring.

Within the housing 11 are provided a DC (direct-current) power supply 15, a controller 18 and an actuating mechanism 28. As shown in FIG. 1, the DC power supply 15 may be a battery or a battery pack, which supplies a voltage of 6 volts, but the voltage value is not limited to 6 volts. The controller 18 may be a printed circuit board which is powered by the DC power supply and connected to a motor 25. The infrared sensor 20 can detect whether the toilet is being used and send the trigger signal according to the user status, namely, by checking whether the user is using or has left the toilet. The structures and the working principle of the above parts, such as the suckers 12, the DC power supply 15, the controller 18, the infrared sensor 20 and the motor 25 are well-known to those skilled in the art, so further explanations are omitted here.

The actuating mechanism 28 can be, for example, a gear mechanism whose input terminal is coupled with the motor 25 and output terminal is an actuating element, such as an end actuator 29, which is arranged in alignment with the opening in the bottom of the housing 22.

FIG. 2 shows how the external automatic flush helper 10 is installed on the toilet tank 30, wherein the suckers 12 are used to fix the flush helper 10 onto the top surface of the toilet tank 30. This installation is quite simple and any consumer can do it by himself. After the installation, the opening 19 in the bottom of the housing 11 will be arranged in alignment with the button (not shown) of the toilet tank 30.

The operation of the external automatic flush helper 10 will be briefly described as follows. When the user is sitting on the toilet seat 40, the infrared sensor 20 provided in the housing 11 of the automatic flush helper 10 can detect the user status (namely there is a user using the toilet) to transmit a trigger signal to a controller 18. After receiving the signal, the controller 18 will make the motor 25 to drive the actuating mechanism 28 to move. Under this condition, the end actuator 29 of the actuating mechanism 28 can be actuated and move out of the opening 19, and thus press the button of the toilet tank 30. Therefore, automatic flushing can be achieved contactlessly. After the button is pressed down, the end actuator 29 will return to its original position.

After using the toilet seat 40, the user can leave directly without doing anything. At this moment, the infrared sensor 20 can also detect the user status (namely, the user has left the seat) to send the trigger signal to the controller 18. Also, the controller 18 will make the motor 25 to drive the actuating mechanism 28 to move. Under this condition, the end actuator 29 of the actuating mechanism 28 can be actuated and move out of the opening 19, and thus press the button of the toilet tank 30. Therefore, automatic flushing can be achieved contactlessly. After the button is pressed down, the end actuator 29 returns to its original position.

Hence, with the external automatic flush helper 10 in accordance with the present invention, the user can achieve the automatic flushing without contacting the button of the toilet tank, thus reducing the possibilities of contacting the bacteria.

In addition, the consumers can provide multiple accessories on the housing 11, such as clock, perfume box, music box, temperature gauge and humidity meter, thus providing multiple extended functions.

As for the water-saving toilet tank with two different buttons (one big flush button and one small flush button) for controlling different amount of flush water to the toilet, it can be provided with two end actuators to be coupled with the two different buttons, so that the two different buttons can be selectively pressed as required.

While we have shown and described various embodiments in accordance with the present invention, it is clear to those skilled in the art that further embodiments may be made without departing from the scope of the present invention.

What is claimed is:

1. An external automatic flush helper comprising:

a housing having an opening;

fixing means for fixing the housing onto an outside of a toilet tank having a button;

a DC power supply provided within the housing;

a controller provided within the housing and powered by the DC power supply;

an infrared sensor and a motor provided within the housing and connected with the controller, and an actuating mechanism provided within the housing and connected with the motor, comprising an end actuator, wherein the end actuator of the actuating mechanism is arranged in alignment with the button of the toilet tank, and the end actuator is actuated and moves out of the opening in the housing when a user status is detected by the infrared sensor and thus presses the button of the toilet tank, wherein the external automatic flush helper forms an independent structure and does not change an original structure of the toilet tank.

2. The external automatic flush helper as claimed in claim 1 characterized in that the fixing means are suckers installed on a bottom of the housing, so that the external automatic flush helper is detachably mounted on the toilet tank.

3. The external automatic flush helper as claimed in claim 1 characterized in that the DC power supply is a battery or a battery pack.

4. The external automatic flush helper as claimed in claim 1 further comprising another end actuator for a toilet tank having a big flush button and a small flush button, wherein the two end actuators are adapted to be selectively used to press the big flush button and the small flush button of the toilet tank for controlling different amount of flush water to a toilet.

5. The external automatic flush helper as claimed in claim 2 further comprising another end actuator for a toilet tank having a big flush button and a small flush button, wherein the two end actuators are adapted to be selectively used to press the big flush button and the small flush button of the toilet tank for controlling different amount of flush water to a toilet.

6. The external automatic flush helper as claimed in claim 3 further comprising another end actuator for a toilet tank having a big flush button and a small flush button, wherein the two end actuators are adapted to be selectively used to press the big flush button and the small flush button of the toilet tank for controlling different amount of flush water to a toilet.

* * * * *